US005358188A

United States Patent [19]

Makino et al.

[11] Patent Number: 5,358,188

[45] Date of Patent: Oct. 25, 1994

[54] SUPERSONIC JET CRUSHER OF COLLISIONAL TYPE

[75] Inventors: Nobuyasu Makino, Numazu; Nagaki Sato, Shizuoka; Toshiyuki Fukase; Hiroyuki Yoshikawa, both of Numazu, all of Japan

[73] Assignee: Ricoh Company, Ltd., Tokyo, Japan

[21] Appl. No.: 183,237

[22] Filed: Jan. 19, 1994

Related U.S. Application Data

[63] Continuation of Ser. No. 842,995, Feb. 28, 1992, abandoned.

[30] Foreign Application Priority Data

Mar. 8, 1991 [JP] Japan ..... 3-069105
Jun. 27, 1991 [JP] Japan ..... 3-183259

[51] Int. Cl.[5] ..... B02C 19/06
[52] U.S. Cl. ..... 241/40; 241/5
[58] Field of Search ..... 241/5, 39, 40

[56] References Cited

U.S. PATENT DOCUMENTS 1,597,656 8/1926 Morton ..... 241/40 X
3,058,674 10/1962 Kocher ..... 241/5 X
4,691,866 9/1987 Beck ..... 241/40 X
4,930,707 6/1990 Oshiro et al. ..... 241/40 X
5,086,982 2/1992 Hirano et al. ..... 241/40

FOREIGN PATENT DOCUMENTS 58-143853 8/1983 Japan .
1-254266 10/1989 Japan .
2-68155 3/1990 Japan .
3021357 1/1991 Japan ..... 241/5
417561 3/1991 Japan ..... 241/5

*Primary Examiner*—Rinaldi I. Rada
*Assistant Examiner*—Clark F. Dexter
*Attorney, Agent, or Firm*—Oblon, Spivak, McClelland, Maier & Neustadt

[57] ABSTRACT

A supersonic jet crusher of a collisional type has an injecting nozzle for injecting a jet stream into a crushing chamber; a jet stream path for supplying a crushing material into the jet stream; a collisional plate disposed in a position opposite to the injecting nozzle; a detachable jig disposed in said crushing chamber; and a secondary collisional plate detachably arranged in the detachable jig such that the crushing material collides with the collisional plate and further collides with the secondary collisional plate. Another supersonic jet crusher of a collisional type has an injecting nozzle for injecting a jet stream into a crushing chamber; a supplying port for supplying a crushing material into the jet stream; and a collisional member opposed to the injecting nozzle and having a crushing face on which the crushing material directly collides against to finely crush the crushing material. The crushing face of the collisional member is vertically moved or rotated with respect to an injecting direction of the jet stream so as change a position of the crushing face to permit the jet stream to directly collide with the collisional member.

5 Claims, 7 Drawing Sheets

SUPERSONIC JET CRUSHER OF COLLISIONAL TYPE

This application is a continuation of application Ser. No. 07/842,995, filed on Feb. 28, 1992, now abandoned.

BACKGROUND OF THE INVENTION

1. Field of the Invention

The present invention relates to a supersonic jet crusher of a collisional type using a high pressure gas constituting a jet stream. More particularly, the present invention relates to a supersonic jet crusher of a collisional type for crushing a crushing material consisting of coarse particles into minute particles.

2. Description of the Related Art

For example, in a general electrophotographic copying machine of a dry type, resin, etc. are changed to fine powder and toner composed of the fine powder is used as developing powder.

Such toner is called dry type toner for an electrostatic charge image. When this toner is manufactured, resin, a dye, a pigment, etc. are melted and kneaded in a thermal roller mill. After the kneaded material is cooled, the kneaded material is coarsely crushed by using a jaw crusher, etc. This crushing material is finely crushed by a supersonic jet crusher.

At the present time, there is a requirement for manufacturing toner with reduced cost by crushing the crushing material with high efficiency. However, when such toner is manufactured by the jet crusher, crushing ability is determined by a primary collision between the crushing material and a collisional plate and a secondary collision between the once-crushed material and a wall of a crushing chamber.

In a large-sized jet crusher having a flow rate of a jet stream equal to or greater than 5 $m^3$/min, the shape of the secondary collisional plate is limited so as not to effect the maintenance of the crusher.

When a collisional member having a crushing face is used, the crushing face is perpendicular to an injecting direction of the jet stream in which maximum impact force is obtained on the crushing face by a crushing action of the coarse material colliding with the collisional member. However, when toner is actually manufactured, the crushing face is partially worn by the frictional crushing action between the crushing face and a raw material of toner as the crushing material when the jet crusher is continuously operated for a long period. Accordingly, it is impossible to maintain an inclination of the crushing face in which the crushing face is inclined 90° with respect to the injecting direction of the jet stream. Therefore, processing ability of the crusher is reduced.

Accordingly, it is desirable to develop a jet crusher of this kind for continuously maintaining the maximum impact force on the crushing face for a long period with respect to particles having a diameter which are required to be crushed.

SUMMARY OF THE INVENTION

It is therefore an object of the present invention to provide a supersonic jet crusher of a collisional type for maintaining maximum impact force with a crushing face for a long period with respect to particles having a diameter which are required to be crushed.

In accordance with a first embodiment of the present invention, the., above object can be achieved by a supersonic jet crusher of a collisional type comprising an injecting nozzle For injecting a jet stream into a crushing chamber; a jet stream path extending from the nozzle for supplying a crushing material into the crushing chamber; a collisional plate disposed in a position opposite to the injecting nozzle; a detachable jig disposed in said crushing chamber; and a secondary collisional plate detachably arranged in a detachable jig such that the crushing material collides with the collisional plate and further collides with the secondary collisional plate.

In the first crusher, the secondary collisional plate is preferably formed approximately in the shape of a circle in cross section. Further, an area for an upper portion of the secondary collisional plate opposite to an upper air flow path located above a center of the jet stream may be set to be smaller than an area for a lower portion of the secondary collisional plate opposite to a lower air flow path located below the center of the jet stream. In this case, the secondary collisional plate is preferably formed approximately in the shape of a horse shoe in cross section.

In accordance with a second embodiment of the present invention, the above object can be achieved by a supersonic jet crusher of a collisional type comprising an injecting nozzle for injecting a jet stream into a crushing chamber; a supplying port for supplying a crushing material into the jet stream; and a collisional member opposed to the injecting nozzle and having a crushing face against which the crushing material along with the jet stream directly collides to finely crush the crushing material. The supersonic jet crusher is constructed such that the crushing face of the collisional member is vertically movable or rotatable with respect to an injecting direction of the jet stream so as to change a position of the crushing face and permit the jet stream to directly collide with the collisional member.

In the second jet crusher, the crushing face of the collisional member is preferably attached to a fixed portion such that the crushing face can be vertically moved or rotated with respect to the injecting direction of the jet stream. Further, a collisional face of the collisional member is preferably constructed by a collisional plate, a base and a fixed shaft.

As mentioned above, the first supersonic jet crusher of a collisional type in the present invention has the injecting nozzle for injecting a jet stream into the crushing chamber; the jet stream path extending from the nozzle for supplying a crushing material into the crushing chamber, and the collisional plate disposed in a position opposite to the injecting nozzle. The supersonic jet crusher further has the secondary collisional plate detachably disposed in the crushing chamber such that the crushed material collides with the collisional plate and further collides with the secondary collisional plate.

Accordingly, the secondary collisional plate can be attached and detached from the crushing chamber in accordance with an injecting speed of the jet stream.

When the secondary collisional plate is approximately formed in the shape of a circle, crushability of the once-crushed material using the secondary collision is improved.

Further, an area at an upper portion of the secondary collisional plate and opposite to an upper air flow path located above a center of the jet stream can be set to be smaller than an area at a lower portion of the secondary collisional plate opposite to a lower air flow path and located below the center of the jet stream. In this case, an air flow velocity is increased in the lower portion of the secondary collisional plate located below the center of the jet stream.

When the secondary collisional plate is approximately formed in the shape of a horse shoe, the area at the lower portion of the collisional plate is increased. Accordingly, after the jet stream collides with the secondary collisional plate, the jet stream tends to flow into this lower portion so that a flow velocity of the jet stream is greatly increased.

In the above second jet crusher of the present invention, a crushing material is supplied from the supplying port into the crushing chamber. The crushed material collides with the opposite collisional member in a state in which the crushing material is included in a jet stream injected from the injecting nozzle. Thus, the crushing material is crushed against the collisional member. In this collision, the collisional member is uniformly worn by moving this collisional member. Accordingly, maximum impact force can be maintained for a long period so that durability of the crusher is greatly improved.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a supersonic jet crusher of a collisional type in the present invention will next be described in detail with reference to the accompanying drawings.

Figure 1:
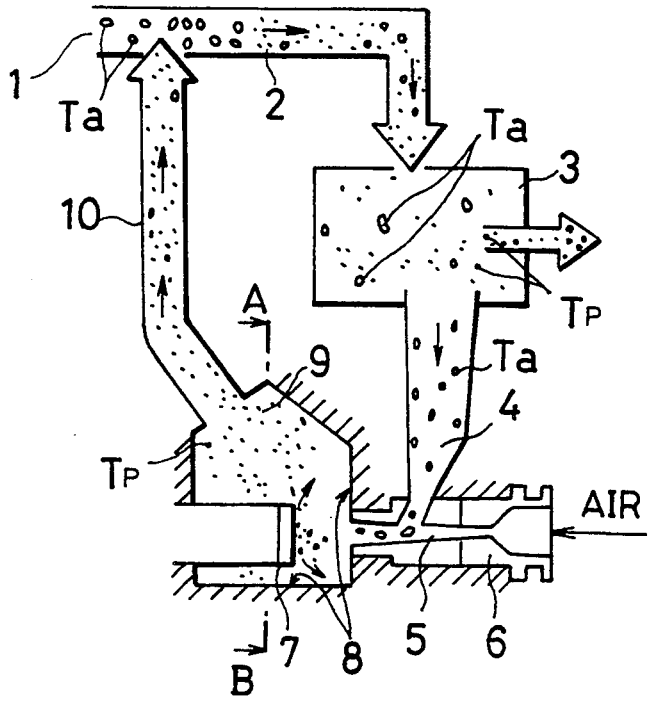
Fig. 1 PRIOR ART
FIG. 1 is a schematic explanatory view showing one example of a general supersonic jet crusher.

FIG. 1 shows one example of a supersonic jet crusher for crushing and changing a crushing material made of resin, etc. to a toner particle. Japanese Patent Application Laying Open (KOKAI) Nos. 58-143853, 2-68155 and 1-254266, and Japanese Utility Model Application Laying Open (KOKAI) No. 51-100574 show crushers each having a main portion approximately conforming to that of the jet crusher shown in FIG. 1.

In FIG. 1, a crushing material Ta is made resin, etc. coarsely crushed and is supplied from a material supplying side 1 of the crusher. The crushing material Ta is guided into a classifying process chamber 3 through a passage 2. The crushing material Ta is directed from the classifying process chamber 3 to a jet stream path 5 through a passage 4.

A high pressure air is injected from a nozzle 6 by the inflow of a compressed air. Accordingly, a supersonic air jet stream is caused in the jet stream path 5. A collisional plate 7 is disposed in a moving direction of this jet stream and is opposed to the nozzle 6.

The crushing material discharged from the passage 4 is guided by the jet stream. While the crushing material is moved in this jet stream at a high speed such as a supersonic speed, the crushing material collides with the collisional plate 7 and further collides with a side face 8.

After the crushing material Ta collides with the collisional plate 7 at the supersonic speed and the side face 8, the crushing material Ta is crushed to minute particles.

Namely, the crushing material is changed to impalpable or fine powder as toner supplied to perform a developing operation. This fine powder Tp is fed from a powder chamber 9 to a passage 10 and is then fed to the classifying process chamber 3 together with the crushing material Ta in the passage 2.

With respect to the crushing material Ta and the fine powder Tp fed to the classifying process chamber 3, the fine powder Tp is collected as a product in an arrow direction in FIG. 1. The crushing material Ta is again fed to the jet stream path 5 through the passage 4 and is crushed against the collisional plate 7.

As mentioned above, the crushing material is crushed by a collision between the crushing material and the collisional plate. Therefore, the supersonic jet crusher of this kind is called a supersonic jet crusher of a collisional type.

In such a jet crusher, the crushing material is crushed by collisions between particles sucked into a jet stream and collisions between these particles and the collisional plate.

In the above-mentioned toner manufacturing process, fine powder having a size equal to or smaller than 100 μm in diameter is classified, selected and used. In this case, it is necessary to satisfy requirements about quality such as a toner particle diameter and a yield value (collected toner/material supplying amount) . It is known that the quality of toner is mostly influenced by the feeding or supplying amount of the crushing material, the crushing air pressure, the crushing air flow amount and the shapes of the collisional plate and the secondary collisional plate.

The collisional plate is disposed in a direction perpendicular to a moving direction of the jet stream. The collisional plate of a plane type has a most excellent crushability so that it is possible to provide sharp classifying effects.

In this case, crushability as a crushing performance is processing ability for obtaining toner having a constant particle diameter distribution.

In the general crusher, known crushing means are generally classified as follows.

(a) Crush using impact (e.g., a hammer mill and an emperor breaker)
(b) Crush using friction and compression (e.g., a roller mill and a tower mill)
(c) Crush using compression (e.g., a jaw crusher and a gyratory crusher)
(d) Crush using impact and friction (e.g., a ball mill and a rod mill)
(e) Crush using impact and shear (e.g., a jet mill and a jet miser)

In many cases, these crushers are selected and used in accordance with crushing ability, crushing efficiency and thermal characteristics of a crushing material. In particular, for example, energy is rapidly increased on a crushing face at a crushing time with respect to the crushing material such as resin powder or toner having thermoplastic resin as a main component, thereby generating heat and increasing temperature on the crushing face. As a result, crushed particles are cohered and fixed to each other and are melted and fixed to the crushing face or a crushing contact portion. Accordingly, it is impossible to use a crusher having the crushing means using impact, friction and compression. In such a case, it is possible to simultaneously use a large amount of a cooling compressed gas or a low temperature gas for providing a great cooling effect as a crushing medium. Accordingly, a crusher using impact and shear such as a jet mill and a jet miser is used.

Figure 7:
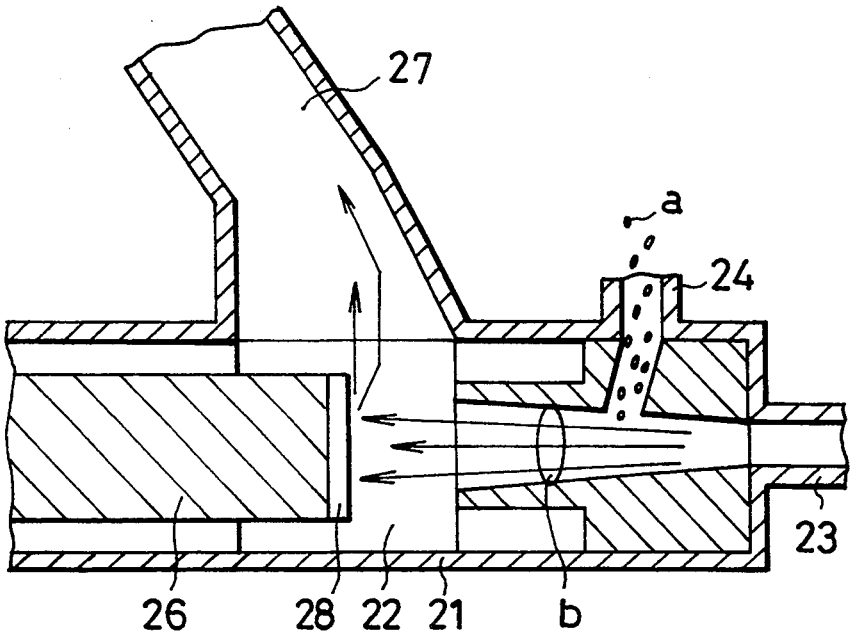
Fig. 7 PRIOR ART
FIG. 7 is a schematic explanatory view showing another example of the general crusher.
Figure 8:
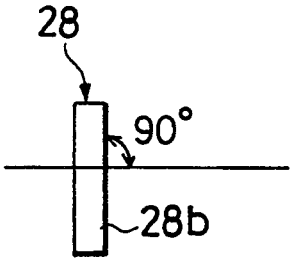
Fig. 8 PRIOR ART
FIG. 8 is a view for explaining the shape of a collisional member disposed in the crusher shown in FIG. 7.

FIG. 7 shows a schematic construction of the general jet type crusher of this kind. FIG. 8 shows the shape of a collisional member used in this crusher. In FIG. 7, a crushing chamber 22 is formed within a casing 21 of the crusher. An injecting nozzle 23 is opened at one end of the crushing chamber 22 to generate a jet stream b. A supplying port 24 is opened in a side portion of the casing 21 near the injecting nozzle 23 within the crushing chamber 22 to supply a crushed material a. A collisional member 28 is fixed to a fixed member 26 such that the collisional member 28 is opposed to the injecting nozzle 23 at the other end of the crushing chamber 22. The crushing material a is supplied by the jet stream b and collides with the collisional member 28. A discharging passage 27 is opened in an outer circumferential portion of the collisional member 28 within the crushing chamber 22. The crushed material a is discharged to an unillustrated collector through the discharging passage 27. In FIG. 7, the collisional member 28 has a crushing face **28*b* formed in the shape of a disk and perpendicular to an injecting direction of the jet stream b as shown in FIG. 8**.

When the collisional member 28 shown in FIG. 8 is used, all of the crushing material a supplied from the supplying port 24 into the crushing chamber 22 directly collides with the disk-shaped crushing face **28*b* of the collisional member 28 perpendicular to the injecting direction of the jet stream b in a state in which the crushing material a is included in the jet stream b injected from a jet stream introducing port of the injecting nozzle 23**. Thus, the crushing material a is finely crushed.

At the present time, there is a requirement for manufacturing toner with reduced cost by crushing the crushing material with high efficiency. However, when such toner is manufactured by the above crusher, crushing ability is determined by a primary collision between the crushing material and the collisional plate and a secondary collision between the crushing material and a wall of the crushing chamber.

Figure 2:
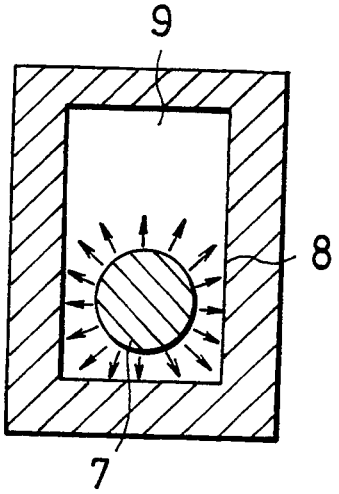
Fig. 2 PRIOR ART
FIG. 2 is a cross-sectional view showing one example of a secondary collisional plate and taken along line A—B in FIG. 1.
Figure 3:
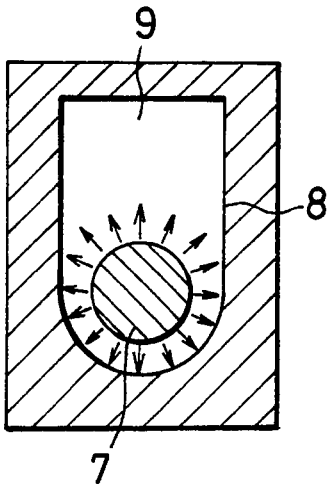
Fig. 3 PRIOR ART
FIG. 3 is a cross-sectional view showing another example of the secondary collisional plate and taken along line A—B in FIG. 1.
Figure 4:
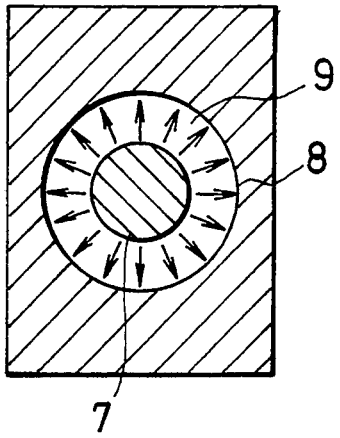
Fig. 4 PRIOR ART
FIG. 4 is a cross-sectional view showing another example of the secondary collisional plate and taken along line A—B in FIG. 1.
Figure 5:
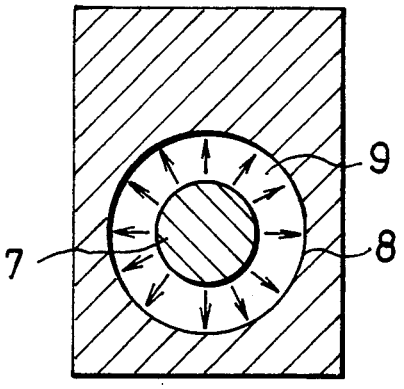
Fig. 5 PRIOR ART
FIG. 5 is a cross-sectional view showing another example of the secondary collisional plate and taken along line A—B in FIG. 1.
Figure 6:
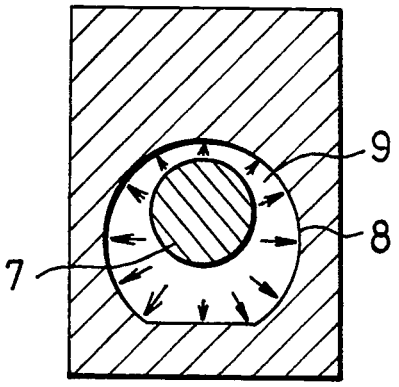
Fig. 6 PRIOR ART
FIG. 6 is a cross-sectional view showing another example of the secondary collisional plate and taken along line A—B in FIG. 1.

FIGS. 2 to 6 are cross-sectional views of various kinds of secondary collisional plates taken along line A—B in FIG. 1. A cross-sectional shape of each of the secondary collisional plates taken along line A—B and shown in FIGS. 2 to 4 is used in FIGS. 5 and 6. It is known that the cross-sectional shape of a secondary collisional plate shown in FIG. 4 has most excellent crushing ability.

In a large-sized crusher having the flow rate of a jet stream equal to or greater than 5 $m^3$/min, the cross-sectional shape of the secondary collisional plate is limited to that shown in FIG. 2 so as not to affect the maintenance of the crusher.

When the collisional member 28 having the crushing face shown in FIG. 8 is used, the crushing face **28*b* is perpendicular to the injecting direction of the jet stream in which maximum impact force is obtained on the crushing face 28*b* by a crushing action of the jet stream against the collisional member 28. However, when toner is actually manufactured, the crushing face 28*b* is partially worn by a frictional crushing action between the crushing face 28*b* and a raw material of toner as the crushing material a when the crusher is continuously operated for a long period. Accordingly, it is impossible to maintain an inclination of the crushing face 28*b* in which the crushing face 28*b*** is inclined 90° with respect to the injecting direction of the jet stream. Therefore, processing ability of the crusher is reduced.

Accordingly, it is desirable to develop a jet crusher of this kind for continuously maintaining the maximum impact force on the crushing face **28*b*** for a long period with respect to particles having a diameter which are required to be crushed.

Figure 9:
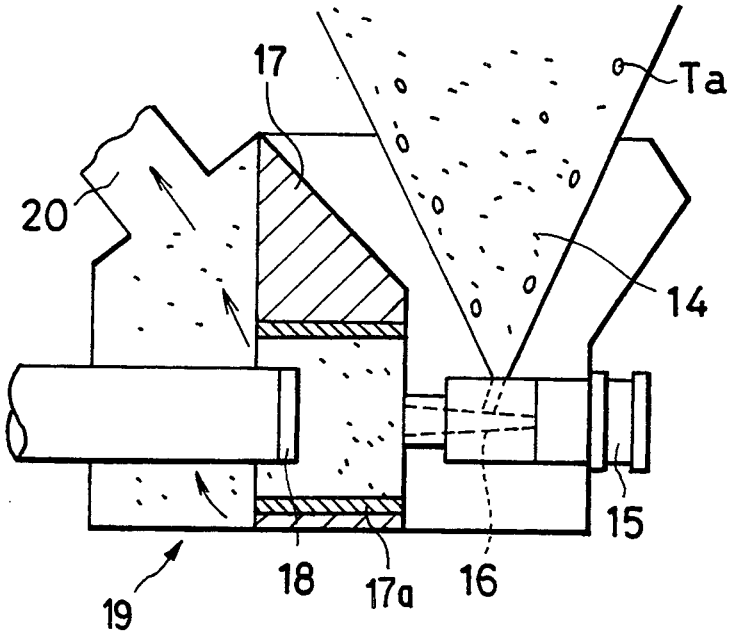
FIG. 9 is a schematic view showing a main portion of a supersonic jet crusher of a collisional type in accordance with a first embodiment of the present invention.
Figure 10:
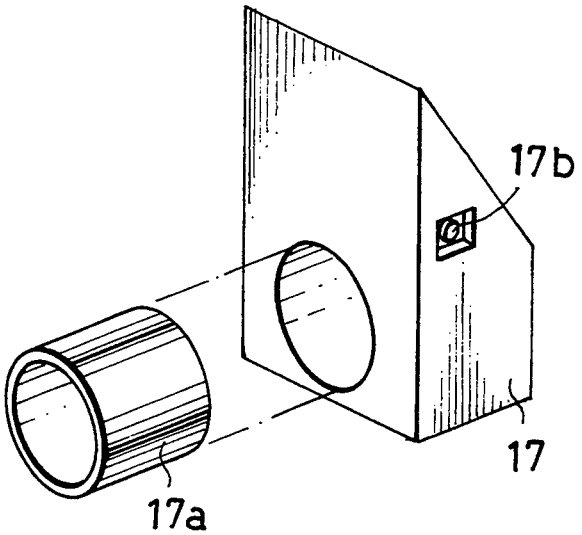
FIG. 10 is a perspective view showing one example of a secondary collisional plate including an outer cover for a crushing chamber and a circular sleeve, arranged in the crusher shown in FIG. 9.
Figure 11:
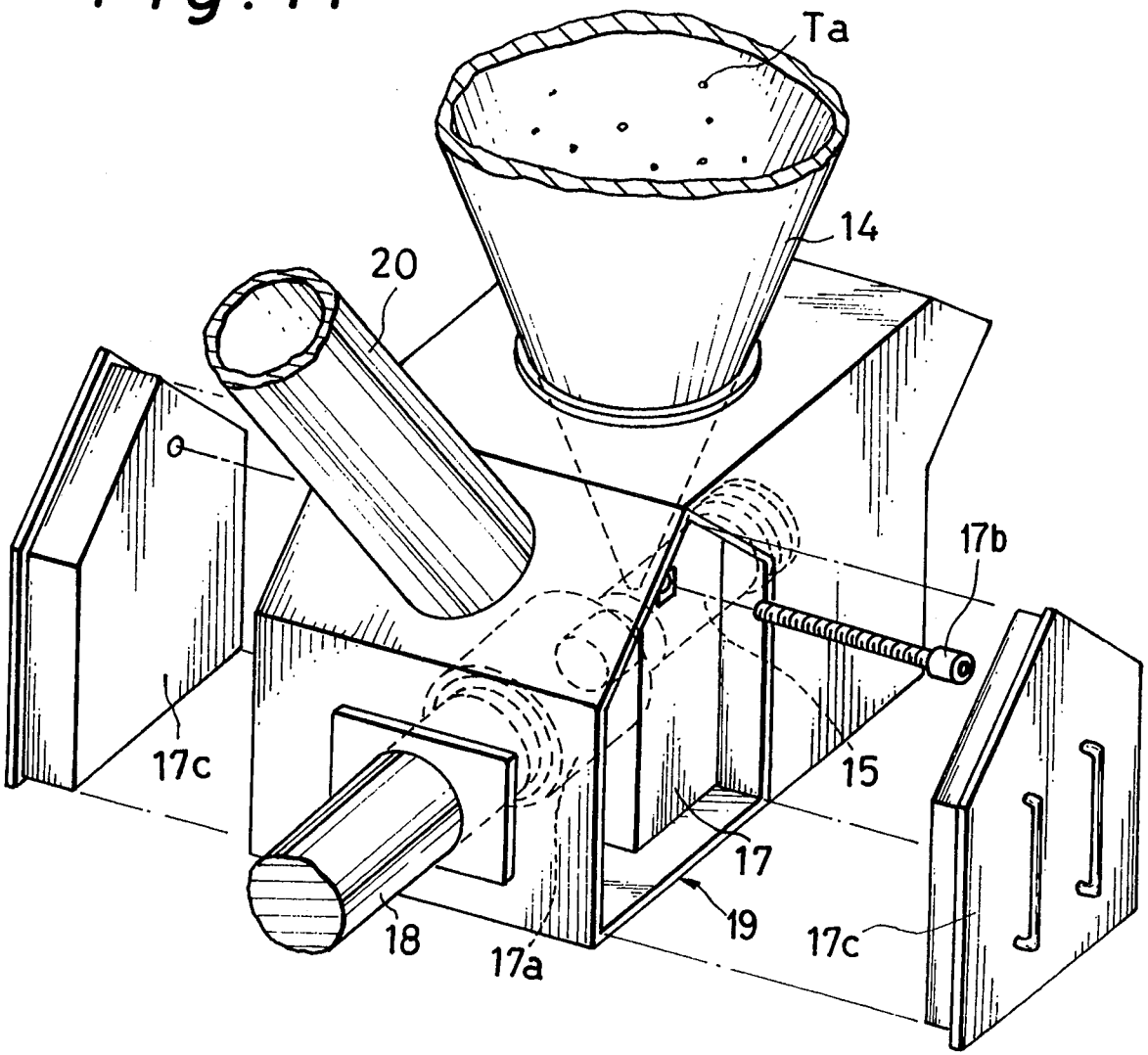
FIG. 11 is a perspective view showing a main portion of a supersonic jet crusher of a collisional type in accordance with a first embodiment of the present invention shown in FIG. 9.
Figure 12:
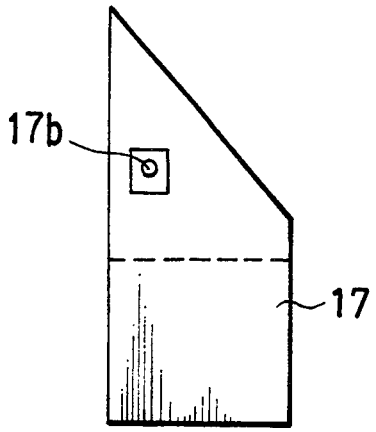
FIG. 12 is a front view of the secondary collisional plate shown in FIG. 10 and seen from one direction.

FIG. 9 is a schematic view showing a main portion of a supersonic jet crusher of a collisional type in accordance with a first embodiment of the present invention. FIG. 10 is a perspective view showing one example of a dedicated jig 17 and a secondary collisional plate **17*a* arranged in the crusher shown in FIG. 9. FIG. 11 is a perspective view showing a main portion of a supersonic jet crusher of a collisional type in accordance with a first embodiment of the present invention shown in FIG. 9. FIG. 12 is a front view of the dedicated jig 17 shown in FIG. 10** and seen from one direction.

Concrete Embodiments 1 to 9 of the present invention will next be described.

EMBODIMENT 1

In FIG. 9 and FIG. 11, a crushing material Ta is supplied to a jet stream path 16 through a passage 14. A high pressure air is injected from an injecting nozzle 15 by the inflow of a compressed air. Accordingly, an air jet stream having a supersonic speed is generated in a jet stream path 16. A collisional plate 18 for crushing the crushing material Ta is opposed to the jet stream path 16 and is arranged in a moving direction of this jet stream.

The crushing material passes through the jet stream path 16 and is moved at a high speed. The crushing material then collides with the collisional plate 18 so that the crushing material is crushed to minute particles. Thereafter, the once-crushed material collides with a secondary collisional plate 17*a* arranged around the collisional plate 18. Thus, the minute particles of the once-crushed material are further crushed to fine particles.

This secondary collisional plate 17*a* is detachably arranged in a dedicated jig 17 as shown in FIG. 10, and outer covers 17*c* which forms walls of a crushing chamber 19 are shown in FIG. 11. The fixed bolt 17*b* is used to detachably attach the dedicated jig 17 to a wall of the crushing chamber 19, and is shown in FIG. 11 attached to one of the outer covers 17*c*. It is possible to change a distance between the collisional plate 18 and the secondary collisional plate 17*a* by replacing this secondary collisional plate 17*a* with another.

For example, the distance between the collisional plate 18 and the secondary collisional plate 17*a* is set to a value from 10 to 50 mm. This distance is most preferably set to a value from 20 to 40 mm. Crushing ability is increased by an interaction between the collisional plate 18 and the secondary collisional plate 17*a*. Further, the diameter of a particle in the crushed material is reduced by this interaction so that a supplying amount of the crushed material is greatly increased, thereby increasing crushing ability.

The secondary collisional plate 17*a* is preferably made of ceramics, nickel, titanium, stainless steel. etc. When ceramics is selected as the secondary collisional plate 17*a*, the secondary collisional plate 17*a* has excellent abrasion, heat and corrosion resistances.

Phthalocyanine pigment having 5 weight percent is mixed with resin composed of polyester resin having 15 weight percent and styrene acrylic resin having 85 weight percent. A mixed material has a softening point temperature of 80° C. The mixed material is melted and kneaded by a thermal roller mill. After the mixed material is cooled, the mixed material is coarsely crushed by a jaw crusher. A secondary collisional plate of a circular type is used in a crushing chamber and a dedicated jig is attached to this secondary collisional plate. The dedicated jig is used to detachably attach the second collisional plate to a wall of the crushing chamber. A distance between the collisional plate and the secondary collisional plate around this collisional plate is set to 45 mm by a circular sleeve. In this state, the mixed material is finely crushed by the supersonic jet crusher. Thus, the crushed material of 60 Kg in weight per one hour can be supplied to obtain fine powder having a volume average particle diameter of 12 μm.

The supersonic jet crusher has a maximum consumed air flow amount of 10 $m^3$/min in this Embodiment 1.

EMBODIMENT 2

In this Embodiment 2, a mixed material and a secondary collisional plate of a circular type disposed in a supersonic jet crusher are similar to those in the above Embodiment 1. The secondary collisional plate is disposed in a crushing chamber. A distance between a collisional plate and the secondary collisional plate around this collisional plate is set to 35 mm. In this state, the mixed material is finely crushed by the supersonic jet crusher. Thus, the crushed material of 63 Kg in weight per one hour can be supplied to obtain fine powder having a volume average particle diameter of 12 μm.

EMBODIMENT 3

Phthalocyanine pigment having 5 weight percent is mixed with resin composed of polyester resin having 75 weight percent and styrene acrylic resin having 15 weight percent. A mixed material has a softening point temperature of 69° C. The mixed material is melted and kneaded by a thermal roller mill. After the mixed material is cooled, the mixed material is coarsely crushed by a jaw crusher. A secondary collisional plate of a circular type is used in a crushing chamber and a dedicated jig is attached to this secondary collisional plate. The dedicated jig is used to detachably attach the second collisional plate to a wall of the crushing chamber. A distance between a collisional plate and the secondary collisional plate around this collisional plate is set to 40 mm. In this state, the mixed material is finely crushed by the supersonic jet crusher. Thus, the crushed material of 60 Kg in weight per one hour can be supplied to obtain fine powder having a volume average particle diameter of 10 μm.

The supersonic jet crusher has a maximum consumed air flow amount of 10 $m^3$/min in this Embodiment 3.

EMBODIMENT 4

In this Embodiment 4, a mixed material and a secondary collisional plate of a circular type disposed in a supersonic jet crusher are similar to those in the above Embodiment 3. The secondary collisional plate is disposed in a crushing chamber. A distance between a collisional plate and the secondary collisional plate around this collisional plate is set to 30 mm. In this state, the mixed material is finely crushed by the supersonic jet crusher. Thus, the crushed material of 65 Kg in weight per one hour can be supplied to obtain fine powder having a volume average particle diameter of 10 μm.

COMPARING EXAMPLE 1

In this example, a mixed material and a supersonic jet crusher are similar to those in the above Embodiment 1. The mixed material is finely crushed by the supersonic jet crusher without using any dedicated jig. Thus, the crushed material of 50 Kg in weight per one hour can be supplied to obtain fine powder having a volume average particle diameter of 12 μm.

COMPARING EXAMPLE 2

In this example, a mixed material and a supersonic jet crusher are similar to those in the above Embodiment 3. The mixed material is finely crushed by the supersonic jet crusher without using any dedicated jig. Thus, the crushed material of 50 Kg in weight per one hour can be supplied to obtain fine powder having a volume average particle diameter of 10 μm.

Experimental results in the above Embodiments 1 to 4 and the comparing examples 1 and 2 are summarized in Table 1.

TABLE 1

| | consumed, air flow | target particle | supplying amount of crushed | shape of secondary collisional |
|---|---|---|---|---|

TABLE 1-continued

| | amount | diameter | material | plate |
|---|---|---|---|---|
| Embodiment 1 | 10 $m^3$/min | 12.0 μm | 60 kg/Hr | circle |
| Embodiment 2 | 10 | 12.0 | 63 | circle |
| Comparing example 1 | 10 | 12.0 | 50 | square |
| Embodiment 3 | 10 | 10.0 | 60 | circle |
| Embodiment 4 | 10 | 10.0 | 65 | circle |
| Comparing example 2 | 10 | 10.0 | 50 | square |

| | distance of secondary collisional plate | processing ability | softening point temperature |
|---|---|---|---|
| Embodiment 1 | 45 mm | 1.2 | 80° C. |
| Embodiment 2 | 35 | 1.26 | 80 |
| Comparing example 1 | — | 1.0 | 80 |
| Embodiment 3 | 40 | 1.2 | 69 |
| Embodiment 4 | 30 | 1.26 | 69 |
| Comparing example 2 | — | 1.0 | 69 |

With respect to processing ability in Table 1, the processing ability in the comparing example 1 is set to 1 in the Embodiments 1 and 2, and the processing ability in the comparing example 2 is set to 1 in the Embodiments 3 and 4.

EMBODIMENT 5

Figure 13:
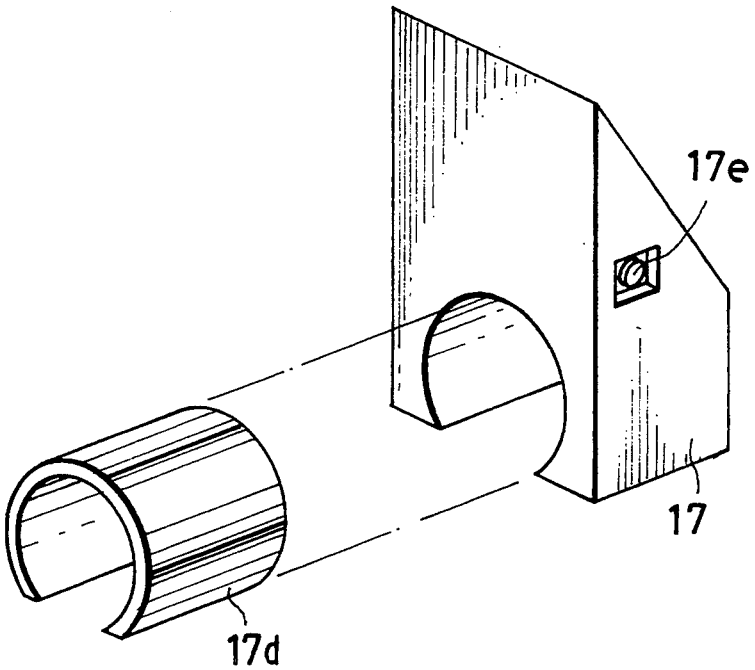
FIG. 13 is a perspective view showing another example of the secondary collisional plate including an outer cover for a crushing chamber and a sleeve of a horse shoe type in the secondary collisional plate, arranged in the crusher shown in FIG. 9.

FIG. 13 is a perspective view showing another example of the secondary collisional plate of a horse shoe type in the crusher shown in FIG. 9 and FIG. 11.

A crushing material passes through the jet stream path 16 shown in FIG. 9 and FIG. 11, and is moved at a high speed. The crushing material then collides with the collisional plate 18 so that the crushing material is crushed to minute particles. Thereafter, the once-crushed material collides with a secondary collisional plate 17*d* arranged around the collisional plate 18. The secondary collisional plate 17*d* is of a horse shoe type and is formed in the shape of a sleeve. Thus, the minute particles of the once-crushed material are further crushed to fine particles. A distance between the collisional plate 18 and the secondary collisional plate 17*d* of a horse shoe type around this collisional plate 18 is reduced on an upper side of the secondary collisional plate 17*d*. Accordingly, the crushed material can be directed toward a passage 20 without storing this crushed material, thereby increasing crushing ability.

The secondary collisional plate 17*d* is preferably made of ceramics, nickel, titanium, stainless steel, etc. When ceramics is selected as the secondary collisional plate 17*d*, the secondary collisional plate 17*d* has excellent abrasion, heat and corrosion resistances.

Phthalocyanine pigment having 5 weight percent is mixed with resin composed of polyester resin having 15 weight percent and styrene acrylic resin having 85 weight percent. A mixed material has a softening point temperature of 80° C. The mixed material is melted and kneaded by a thermal roller mill. After the mixed material is cooled, the mixed material is coarsely crushed by a jaw crusher. A secondary collisional plate of a circular type is used in a crushing chamber and a dedicated jig is attached to this secondary collisional plate. The dedicated jig is used to detachably attach the second collisional plate to a wall of the crushing chamber. A distance between the collisional plate and the secondary collisional plate around this collisional plate is set to 45 mm by a circular sleeve. In this state, the mixed material is finely crushed by the supersonic jet crusher. Thus, the crushed material of 61 Kg in weight per one hour can be supplied to obtain fine powder having a volume average particle diameter of 12 μm.

The supersonic jet crusher has a maximum consumed air flow amount of 10 $m^3$/min in this Embodiment 5.

EMBODIMENT 6

In this Embodiment 6, a mixed material and a secondary collisional plate of a circular type disposed in a supersonic jet crusher are similar to those in the above Embodiment 5. The secondary collisional plate is disposed in a crushing chamber. A distance between a collisional plate and the secondary collisional plate around this collisional plate is set to 35 mm. In this state, the mixed material is finely crushed by the supersonic jet crusher. Thus, the crushed material of 65 Kg in weight per one hour can be supplied to obtain fine powder having a volume average particle diameter of 12 μm.

EMBODIMENT 7

Phthalocyanine pigment having 5 weight percent is mixed with resin composed of polyester resin having 75 weight percent and styrene acrylic resin having 15 weight percent. A mixed material has a softening point temperature of 69° C. The mixed material is melted and kneaded by a thermal roller mill. After the mixed material is cooled, the mixed material is coarsely crushed by a jaw crusher. A secondary collisional plate of a circular type is used in a crushing chamber and a dedicated jig is attached to this secondary collisional plate. The dedicated jig is used to detachably attach the second collisional plate to a wall of the crushing chamber. A distance between a collisional plate and the secondary collisional plate around this collisional plate is set to 40 mm. In this state, the mixed material is finely crushed by the supersonic jet crusher. Thus, the crushed material of 61 Kg in weight per one hour can be supplied to obtain fine powder having a volume average particle diameter of 10 μm.

EMBODIMENT 8

In this Embodiment 8, a mixed material and a secondary collisional plate of a circular type disposed in a supersonic jet crusher are similar to those in the above Embodiment 7. A dedicated jig is attached to the secondary collisional plate and this secondary collisional plate is disposed in a crushing chamber. The dedicated jig is used to detachably attach the second collisional plate to a wall of the crushing chamber. A distance between a collisional plate and the secondary collisional plate around this collisional plate is set to 30 mm. In this state, the mixed material is finely crushed by the supersonic jet crusher. Thus, the crushed material of 70 Kg in weight per one hour can be supplied to obtain fine powder having a volume average particle diameter of 10 μm.

COMPARING EXAMPLE 3

In this example, a mixed material and a supersonic jet crusher are similar to those in the above Embodiment 5. The mixed material is finely crushed by the supersonic jet crusher without using any dedicated jig. Thus, the crushed material of 50 Kg in weight per one hour can be supplied to obtain fine powder having a volume average particle diameter of 12 μm.

COMPARING EXAMPLE 4

In this example, a mixed material and a supersonic jet crusher are similar to those in the above Embodiment 7. The mixed material is finely crushed by the supersonic jet crusher without using any dedicated jig. Thus, the crushed material of 50 Kg in weight per one hour can be supplied to obtain fine powder having a volume average particle diameter of 10 μm.

Experimental results in the above Embodiments 5 to 8 and the comparing examples 3 and 4 are summarized in Table 2.

TABLE 2

| | consumed, air flow amount | target particle diameter | supplying amount of crushed material | shape of secondary collisional plate |
|---|---|---|---|---|
| Embodiment 5 | 10 $m^3$/min | 12.0 μm | 61 kg/Hr | horse shoe |
| Embodiment 6 | 10 | 12.0 | 65 | horse shoe |
| Comparing example 3 | 10 | 12.0 | 50 | square |
| Embodiment 7 | 10 | 10.0 | 61 | horse shoe |
| Embodiment 8 | 10 | 10.0 | 70 | horse shoe |
| Comparing example 4 | 10 | 10.0 | 50 | square |

| | distance of secondary collisional plate | processing ability | softening point temperature |
|---|---|---|---|
| Embodiment 5 | 45 mm | 1.22 | 80° C. |
| Embodiment 6 | 35 | 1.30 | 80 |
| Comparing example 3 | — | 1.0 | 80 |
| Embodiment 7 | 40 | 1.22 | 69 |
| Embodiment 8 | 30 | 1.40 | 69 |
| Comparing example 4 | — | 1.0 | 69 |

With respect to processing ability in Table 2, the processing ability in the comparing example is set to 1 in the Embodiments 5 and 6, and the processing ability in the comparing example 4 is set to 1 in the Embodiments 7 and 8.

A jet crusher in accordance with a second embodiment of the present invention will next be described in detail.

Figure 14:
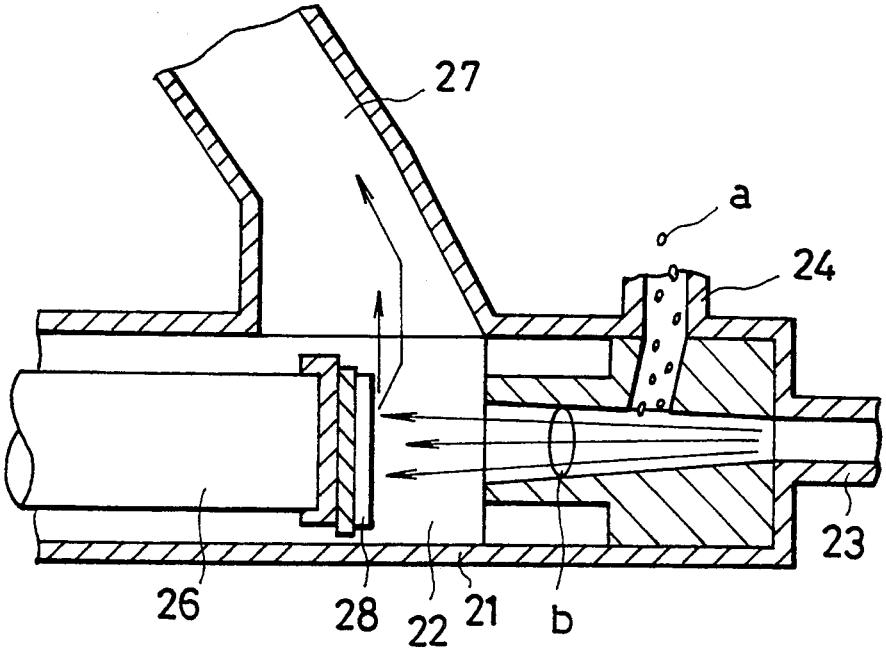
FIG. 14 is a schematic explanatory view showing a main portion of a crusher in accordance with a second embodiment of the present invention.
Figure 15:
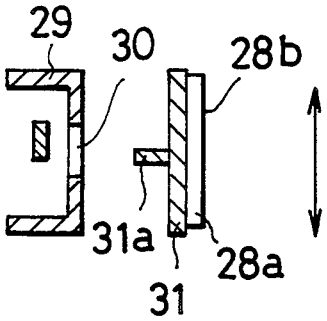
FIG. 15 is a side view showing one example of a collisional portion of the crusher shown in FIG. 14.

FIG. 14 is a cross-sectional explanatory view showing the schematic construction of a crusher of a jet mill type used in the following concrete Embodiment 9. FIG. 15 is a side view showing the shape of a collisional section used in this crusher of a jet mill type. In FIGS. 14 and 15, constructional portions similar to or corresponding to those in FIGS. 7 and 8 are designated by the same reference numerals.

EMBODIMENT 9

In FIG. 14, a crushing chamber 22 is formed within a casing 21 of this crusher. An injecting nozzle 23 is opened at one end of the crushing chamber 22 to generate a jet stream b. A supplying port 24 is opened in a side portion of the casing 21 near the injecting nozzle 23 within the crushing chamber 22 to supply a crushed material a. A collisional member 28 is fixed to a fixed member 26 such that the collisional member 28 is opposed to the injecting nozzle 23 at the other end of the crushing chamber 22. The collisional member 28 constitutes features of the present invention. The crushed material a supplied by the jet stream b collides with the collisional member 28. A discharging passage 27 is opened on a side of the collisional member 28 within the crushing chamber 22. The crushed material a is discharged to an unillustrated collector through the discharging passage 27.

In FIG. 14, a cover 29 shown in FIG. 15 is arranged behind a collisional plate **28*a* and a crushing face 28*b* of the collisional member 28. An elongated hole is disposed in a central portion of the cover 29. A base 31 is arranged at an end of the cover 29 and the collisional plate 28*a* can be attached to this base 31. A fixed shaft 31*a* is connected onto a rear face of the base 31. When the fixed shaft 31*a* is inserted into the elongated hole 30, it is possible to vertically move or rotate the base 31 and the collisional plate 28*a* attached onto an end face thereof. Thus, the collisional plate 28*a* can be moved while the injecting direction of a jet stream injected from the injecting nozzle 23 is inclined 90 degrees with respect to the collisional plate 28*a*** and this inclination angle is held.

In this case, the crushing material a is composed of:
polyester resin having 15 weight percent;
a magnetic substance having 30 weight percent;
styrene acrylic resin having 50 weight percent; and
a dye having 5 weight percent.

This crushing material a is melted and kneaded by a thermal roller mill. After the crushing material is cooled, the crushing material is coarsely crushed by a jaw crusher. The collisional member of a movable type shown in FIG. 14 and the collisional member of a fixed type shown in FIG. 7 are used in the crusher. A compressed air having a crushing pressure 6.0 kg/$cm^2$ and a flow amount 10 $m^3$/min is used as the jet stream b. The crushing material a is finely crushed by this compressed air to minute particles having 10 μm in diameter. The following Table 3 compares discharging amounts of fine powder in the general crusher and the crusher of the present invention.

TABLE 3

| | discharging amount kg/hr in general crusher | discharging amount kg/hr in crusher in Embodiment 9 |
|---|---|---|
| accumulated operating time | | |
| 500 | 32.0 | 32.0 |
| 1000 | 30.0 | 33.0 |
| 1500 | 27.0 | 32.0 |
| 2000 | 25.0 | 31.0 |
| average | 28.5 | 32.0 |

The collisional member 28 shown in FIG. 15 is rotated 45° with respect to the injecting nozzle 23 every 500 hours.

As mentioned above, in a first embodiment of the present invention, a supersonic jet crusher of a collisional type has an injecting nozzle for injecting a jet stream into a crushing chamber; a jet stream path for supplying a crushing material into the jet stream; a collisional plate disposed in a position opposite to the injecting nozzle; and a secondary collisional plate detachably disposed in the crushing chamber such that the crushing material collides with the collisional plate and further collides with the secondary collisional plate.

Accordingly, the secondary collisional plate can be attached and detached from the crushing chamber in accordance with an injecting speed of the jet stream.

Therefore, it is possible to effectively crush the once-crushed material by a secondary collision.

When the secondary collisional plate is approximately formed in the shape of a circle, crushability of the once-crushed material using the secondary collision is improved so that crushing efficiency is greatly increased.

Further, an area for an upper portion of the secondary collisional plate opposite to an upper air flow path located above a center of the jet stream can be set to be smaller than an area for a lower portion of the secondary collisional plate opposite to a lower air flow path located below the center of the jet stream. In this case, an air flow velocity is increased in the lower portion of the secondary collisional plate located below the center of the jet stream. Accordingly, no crushed material is stored within the crushing chamber so that effects similar to the above-mentioned effects can be obtained.

When the secondary collisional plate is formed in the shape of a horse shoe, the air flow velocity is greatly increased in the lower portion of the secondary collisional plate located below the center of the jet stream so that the above-mentioned effects can be greatly obtained.

In a crusher in accordance with a second embodiment of the present invention, a crushing material is supplied from a supplying port into a crushing chamber. The crushing material collides with an opposite collisional member in a state in which the crushing material is included in a jet stream injected from an injecting nozzle. Thus, the crushing material is crushed by the collisional member. In this collision, the collisional member is uniformly worn by moving this collisional member. Accordingly, maximum impact force can be maintained for a long period so that durability of the crusher is greatly improved.

Many widely different embodiments of the present invention may be constructed without departing from the spirit and scope of the present invention. It should be understood that the present invention is not limited to the specific embodiments described in the specification, except as defined in the appended claims.

What is claimed is:

1. A supersonic jet crusher of a collisional type comprising:

a crushing chamber having at least one detachable outer cover forming a wall of the crushing chamber;

an injecting nozzle for injecting a jet stream into said crushing chamber;

a jet stream path extending from said nozzle to said crushing chamber for supplying a crushing material into said crushing chamber;

a collisional plate positioned in said crushing chamber and disposed in a position in line with said jet stream path and opposite to said injecting nozzle for crushing said crushing material supplied by said jet stream;

a detachable jig disposed in said crushing chamber; and a secondary collisional plate detachably attached to said detachable jig such that the crushing material collides with said collisional plate and further collides with the secondary collisional plate.

2. The supersonic jet crusher of a collisional type according to claim 1, wherein a cross section of said secondary collisional plate is approximately formed in the shape of a circle.

3. The supersonic jet crusher of a collisional type according to claim 1 or 2, wherein a distance between the collisional plate and the secondary collisional plate is set in such a manner that the distance on an upper side of said secondary collisional is smaller than the distance on a lower side of said secondary collisional plate.

4. A supersonic jet crusher of a collisional type according to claim 3, wherein a cross section of said secondary collisional plate is approximately formed in the shape of a horse shoe.

5. The supersonic jet crusher of a collisional type according to claim 1, wherein said detachable jig is detachably attached to a wall of the crushing chamber.

* * * * *